US007374514B2

(12) United States Patent
Anderson

(10) Patent No.: US 7,374,514 B2
(45) Date of Patent: May 20, 2008

(54) ECONOMICAL FOAM STILTS

(76) Inventor: Ted G Anderson, 9301 Avondale Rd., Building T2114, Redmond, WA (US) 98052

( * ) Notice: Subject to any disclaimer, the term of this patent is extended or adjusted under 35 U.S.C. 154(b) by 54 days.

(21) Appl. No.: 11/378,112

(22) Filed: Mar. 18, 2006

(65) Prior Publication Data

US 2007/0219070 A1 Sep. 20, 2007

(51) Int. Cl.
*A63B 25/00* (2006.01)
*A61F 2/60* (2006.01)

(52) U.S. Cl. ..... 482/75; 623/28

(58) Field of Classification Search ..... 482/75–77; 623/23, 28–29; 182/30, 129, 230; 5/630; 248/118.1, 918
See application file for complete search history.

(56) References Cited

U.S. PATENT DOCUMENTS

| | | | | |
|---|---|---|---|---|
| 3,595,339 | A * | 7/1971 | Ballard et al. | 182/230 |
| 4,449,256 | A * | 5/1984 | Prueitt | 482/75 |
| 5,199,124 | A * | 4/1993 | Klemis | 5/630 |
| 5,593,373 | A * | 1/1997 | Hale | 482/75 |
| 5,645,515 | A * | 7/1997 | Armstrong et al. | 482/75 |
| 7,070,023 | B2 * | 7/2006 | Waxler | 182/230 |
| 2004/0176221 | A1 * | 9/2004 | Waxler | 482/75 |
| 2005/0121562 | A1 * | 6/2005 | Baumgardner | 248/118.1 |

* cited by examiner

*Primary Examiner*—Fenn C Mathew

(57) ABSTRACT

Two blocks of structural foam are fitted with shoe buckles. The blocks have ground contacting areas larger than the user's shoes for stability, and to reduce the toss-over effects of stepping on construction junk on the floor. Small objects embed in the resilient surface of the foot so their effect on walking and stability are nullified.

19 Claims, 2 Drawing Sheets

ECONOMICAL FOAM STILTS

RELATED APPLICATION

None

U.S. GOVERNMENT INTEREST IN THE INVENTION

None

BACKGROUND OF THE INVENTION

1. Field of the Invention

Walking platform for extending the reach of drywall installers, plasters, painters, arborists, fruit pickers, shelf stockers, inventory counters, etc.

2. Description of Related Art

Walking stilts for elevating painters and drywall installers so they can reach the ceiling of a room have been around for some time.

The essential parts of a drywall installer's stilt are a means to attach the stilt to the user's boot, a ground engaging foot structure, and a means to hold the boot attachment and the ground engaging foot apart in a vertically oriented relationship.

Various designs of these essential elements are described in the literature, some are on the market and in use by the construction industry.

Almost all are some form of fixed or articulated connection between the human's boot and a ground engaging foot. U.S. Pat. No. 5,645,515 by William Armstrong is typical. Many other examples of similar structures are easy to find in the patent data base.

These buckled on stilts are well made of machined parts and thus are very expensive. Several hundred dollars per pair.

The ground engaging foot is invariably no larger than the shoe on the human foot, and in some examples, it is narrower and/or shorter. Most have some articulation so that the ground foot operates with a "natural" longitudinal toe to heel flexibility. None were found with lateral flexibility which would permit the wearer to sense the ground foot stepping on a piece of construction junk so the ankle could respond to, or possess capability to absorb the unevenness of stepping on construction junk and small items such as nails and drywall screws. As a result, falling is common and the extra height makes falling all the more likely to result in injury.

The dangers encountered in use, the cost, and an inappropriately designed ground foot has discouraged using the available stilts in other applications where extending height and reach would be a valuable asset.

U.S. Pat. No. 5,593,373 by Russell Hale overcomes the cost problem by using recycled buckets as the elevating platform. A bucket does provide more area than the human foot, but the ground engaging area is shaped differently. Also a bucket has marginal strength at the rim, and the sides may buckle under load. Buckets simply were not designed to be walked upon in the manner Hale describes. Currently, good, strong, metal buckets are becoming scarcer. Plastic buckets are rapidly replacing metal buckets for nearly every use. Plastic buckets will have wider variation in shape, cross section, and material strengths. Choosing one that is strong enough to be used safely may be beyond the ability of Mr. Hale's targeted user.

Another problem with Mr. Hale's bucket stand is that the ground engaging portion is circular. This separates the extended feet. Since the buckets are axially vertical, the ground separation is directly translated to the wearer's foot positions. The wearer will have to "duck walk", which is less stable, especially when gazing upwards.

Mr. Hale's bucket may step over construction junk, placing the junk inside the bucket rim. The next step might drag the junk, which may be attached to something, or simply be heavy, and cause stumbling. If a workman steps on a nail, drywall screw, or similar, a spot of high stress occurs on the rim. This could induce the bucket wall to buckle, which would quickly propagate into a total failure of the supporting bucket.

The present invention also has an oversize ground engaging area, but it is full contact, shaped, and positioned relative to the wearer's foot that the wearer walks naturally and the effects of stepping on junk is minimized, and in some cases transferred to the foot as a natural feel of an irregular walking surface, which is automatically compensated for by the user's sensing and proprioceptor nerves and muscle system.

3. Objects of the Invention

It is an object of the invention to provide a platform attachment to the foot of a workman so that he may walk around the worksite elevated 1 to 2 feet over the floor.

It is another object of the invention to provide a stable platform for standing upon that has a ground engaging foot having an area at least as large as the user's boot.

It is another object of the invention to provide safety features to avoid leg and ankle damage if the user should fall off the height extending invention.

It is another object of the invention to be stable enough that a workman can with reasonable safely walk around with his hands and gaze over his head, especially while holding a tool or load.

It is another object of the invention to provide shoe fastening that may be buckled and unbuckled with one hand and not having to be within the eyesight of the user.

It is another object of the invention that the cost be low.

It is another object of the invention to provide a natural gait for balance and stability. Feet not abnormally separated.

It is another object of the invention to provide a walking platform, that is intuitive to put on and intuitive to use; no significant learning curve.

It is another object of the invention to provide a walking platform relatively insensitive to walking over junk on the floor.

It is another object of the invention that there be no moving parts other than in the shoe buckling system.

BRIEF SUMMARY OF THE INVENTION

Two large blocks of structural foam are fitted with shoe engaging buckles comprising quick release hook and loop fastenings (IE Velcro™). The user attaches his feet (boots) to the blocks and walks along carrying the blocks with him.

The general shape of the blocks is a rectangular parallelopiped. The axis of support is vertical, extending from the wearer's tibia bone and terminating at the ground under his foot.

The shoe platform is at least as large as the user's boot, and usually extends beyond the toe, heel, and each side of the user's boot. This boot platform area is projected to the ground contacting lower surface as the primary ground contacting foot. In addition, an laterally outward extension of the ground contacting foot is added at the heel for lateral stability. The extension is a block of the foam extending a distance approximately ⅔ the width of the foot and forward approximately 57% of the length of the foot.

The extension provides significant lateral stability as well as to moderate the effects of stepping on construction junk or in the case of an arborist, uneven ground.

The shoe attachment breaks away from the block or unlatches if the user should fall sideways. This protects the ankle and leg from being strained or broken due to lateral loads imposed by falling.

TABLE OF IDENTIFIED DETAILS

Figure 1:
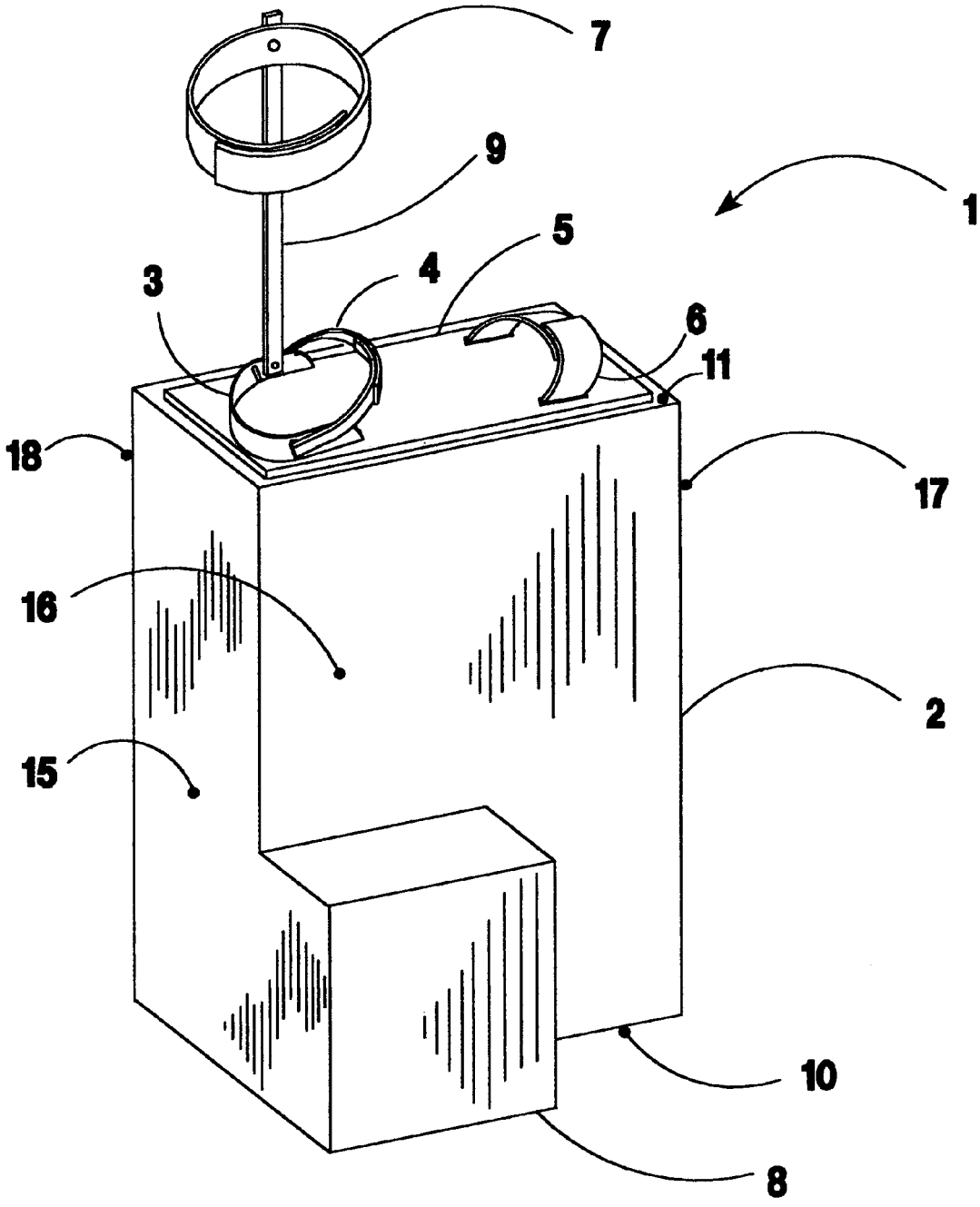
FIG. 1 is an isometric view of the invention.

1. The right-foot stilt in its entirety
2. The core block of the stilt
3. Heel stop
4. Ankle strap
5. Boot clamp base plate
6. Boot toe strap
7. Calf encircling strap
8. Lateral stabilizing block and ground engaging surface
9. Stabilizing post for calf encircling strap
10. Primary ground engaging foot, ground engaging surface
11. Boot support surface, upper surface
12. Typical strut
13. Strut mounting base
14. Alternative separation means using struts
15. Back (heel) vertical surface
16. Outer vertical surface
17. Front (toe) vertical surface, (hidden in the FIG. 1 view)
18. Inside vertical surface, interior vertical surface, facing sides of the core blocks, (hidden in the FIG. 1 view).

DEFINITIONS

The following words are to be interpreted broadly and the definitions extend to all verbs, adverbs, adjectives, nouns, gerunds, tenses, etc. derived therefrom.

Boot—includes all kinds of footwear including oxford style shoes.

Foot—includes, depending on context, a shod human foot or the distal end of an appliance (the present invention) applied to a human foot and leg.

Buckle—any means for temporarily joining two straps or two ends of a strap. Includes hook-and-loop means, snaps, hooks, buttons, ring and tang buckles, friction buckling devices, etc.

Structural foam—any semi-rigid material having entrained air pockets and having sufficient strength for supporting a person in the configuration described herein. Styrofoam™, by Owens Corning Company, or polystyrene foam slabs are the preferred material.

Rectangular parallelopiped—a solid where each of the 6 sides are rectangles. However, modification to the parallelopiped such as rounding (even severely rounding) the edges, or slightly tapering for manufacturing processing purposes will be considered as still being a parallelopiped for the purposes of this disclosure and attached claims.

Floor—any surface intended to be walked upon. Includes earthen, concrete, grass, wooden, constructed floors, platforms, decks, etc surfaces.

DETAILED DESCRIPTION OF THE INVENTION

The design of the stilt described herein is adapted to be a natural walking surface elevated 1 to 2 or more feet above the floor. The ground engaging foot is resilient and can deform around small objects. The primary portion 10 of the ground engaging foot may be slightly larger than the sole of a boot, and has an extension to the outside that is about ⅔ the width of the boot platform. The lift is a solid block of structural type plastic foam, and the boot clamping means is primarily hook and loop fastening straps securely attached to the lift block. One strap goes around the user's ankle and the other over the boot toe.

FIG. 1 shows the right stilt 1 of a left-right pair. The left stilt is identical except for being reversed across the heel-toe axis.

Core block 2 in the preferred embodiment is a solid block of structural foam. The upper surface 11 is large enough to accommodate a workman's boot. The upper surface width and length is usually only slightly larger than the largest boot expected to be accommodated, but may be as small as the boot sole. Six inches wide, and fourteen inches long has been found satisfactory for a 2 foot high stilt. A shoe binding adapter is securely attached to the upper surface of block 2. The adapter is comprising a heel stop 3, an ankle strap 4, and a toe strap 5.

The shoe binder is shown in FIG. 1 as being attached to a mounting base plate 5 which is then securely fastened to the lift block 2 by glueing, pins, bolts, or casting into block 2, or some combination of these or similar. Gluing alone has been found to be an adequate fastening method. A leg brace comprising post 6 and calf encircling strap 7 is included for safety. While is possible to use the present stilts without the leg brace, the probability of falling off is reduced immeasurably by the extra anti-buckling characteristic of the leg brace.

FIG. 1 illustrates the hook and loop fastening as simple overlapping connection Having the strap pass through rectangular rings or slots then folding back onto itself then fastening is also a very satisfactory way to route and fasten all the straps. Other buckling means may be employed as needed.

The lateral stabilizer block 8 extends from the outer face of the lift block 2 approximately under the heel of the wearer's boot. Block 8 extends from the back edge of block 2 to approximately 55 to 65% of the length of block 2, and extends outwardly from the outer face of block 2 approximately ⅔ the width of block 2. Dimensions found satisfactory are 6×14 inches for the upper surface and the primary portion of the ground engaging surface, and stabilizing block 8 being 4 inches wide and 8 inches long.

The ground engaging foot is comprised of resilient material. The structural foam of the lift block 2 is has adequate resilience, therefore, the foot is simply the foam portion at the bottom of block 2. The resilience of the foot permits the foot to yield and enclose small objects, thereby nullifying the effects of stepping on them.

As illustrated in FIG. 1, the boot platform 11 and the ground engaging foot 8+10 are fixedly held one above the other coaxially, and in parallel orientation to each other. Note, this is a definitive characteristic of a rectangular parallelopiped shape. Because Block 2 has a margin around the boot, the primary area 10 of the bottom ground engaging foot is slightly larger than the boot, plus an additional area of the lateral stabilizing block 8.

ALTERNATIVE EMBODIMENTS AND VARIATIONS OF THE INVENTION

FIG. 1 shows the lift block 2 and the side stabilizer block 8 as parallelopiped shaped with rectangular corners. There is no reduction in utility if the vertical edges of the lift block and the stabilizing block are rounded, nor if the interior corners are filleted any convenient amount. A modest expansion of cross section from the boot surface to the ground engaging surface for the purpose of providing mold draft or similar is anticipated and does not change the function or override the objects of the invention nor is it intended that minor non-parallelism of block 2 edges or faces, or rounding of the edges, nullify the description of block 2 being described as essentially a rectangular parallelopiped shape.

Toe and ankle strapping 4 and 6, and the heel block 3 may be embedded within the lift block 2, thereby eliminating the mounting base plate 5.

Stabilizing block 8 may be attached to the lift block 2 by any convenient means such as glueing, integrally molded, bolts, pins, etc, or a combination of these and similar fastening methods.

The ground engaging foot is comprised of resilient material. In the preferred embodiment, the foot is integral to and comprised of the same foam as the rest of the lift block 2. However, as an alternative, less desirable embodiment, the foot may be a separate block of 1½ to 2½ inches thick and the same shape and characteristics as described, but separated from the boot engaging means by a set of struts or other rigid structure. While structural foam is the preferred material, in all embodiments, the resilient material may be any other substance with the properties of yielding to enclose small objects on the floor when stepped upon.

Figure 2:
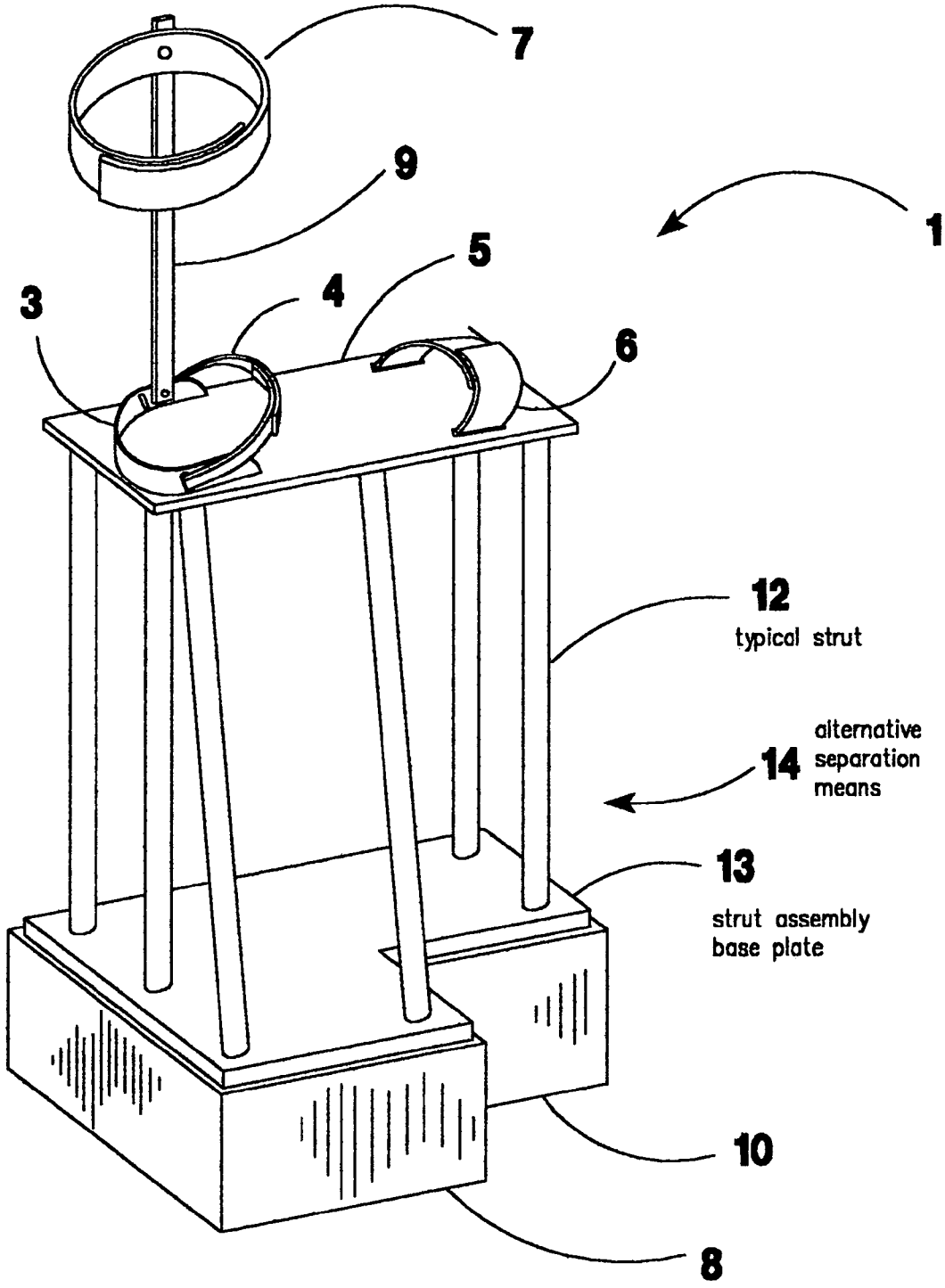
FIG. 2 is an isometric view of the invention using a post or strut structure to separate the stilt foot from the boot clamp.

This alternate embodiment is illustrated in FIG. 2, as item 1. Item 14, alternate separation means, comprising a set of struts or posts 12 attached to the boot clamp plate 5 and strut base 13, to which foot block 8&10 is attached, describes a alternative embodiment of the stilt.

HOW TO USE THE INVENTION

Using the present invention is entirely intuitive. The blocks are strapped on the feet (boots) and one simply stands on the flat upper surface. As one walks, the blocks follow in a natural way, and because the ground engaging foot does not extend significantly beyond the boot toe, the striding motion even rocks naturally on the toe (forward) and heel edges.

The user's feet stand upon a flat surface parallel to the floor, and the stability of the floor engaging means is greater than that of a boot alone, thus the sensation and subsequent balance is the same as or nearly identical to standing on the floor itself. This permits the user to do the activities he would do from the floor such as looking and/or reaching upward while moving about. He should exercise at least the same care on the stilts as when moving on the floor with the same attitude.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention as defined by the claims which follow.

The embodiments of the invention in which an exclusive property right or privilege is claimed are defined as follows:

I claim:

1. A stilt for raising a walker above a floor comprising:

a. a pair of approximately rectangular blocks of structural foam material serving as the core structure of the stilts, b. each block having an upper planer surface having a means to removably secure a boot to said upper surface, and an opposite ground engaging surface approximately the same size and shape as said upper surface, a post vertically extending from the upper planar surface, said post further including means for removably securing a lower leg portion of a user to said post in order to provide stability during use of said stilt, and c. said upper surface having edges proximal to the boot heel, toe, inner side, and outer side, and said ground engaging surface having edges essentially parallel to the corresponding upper surface edges, and vertical surfaces extending between said upper edges and lower corresponding edges, and d. whereby when the pair of stilts is worn by a walker, the walker's stance is normal, when standing his legs are in normal vertical alignment, and when walking said interior edges and surfaces of said core blocks do not collide.

2. The stilt of claim 1 where said ground engaging surface further having an extension surface extending outwardly from the outer edge and forwardly from the heel edge toward the toe edge and coplanar with said ground engaging surface of said core block, where said extension is the lower surface of a block extending upwardly part way to the level of said uppersurface of said core block.

3. The stilt of claim 1 where the vertical corner edges of said core blocks are chamfered.

4. The stilt of claim 1 where the vertical corner edges of said core blocks are rounded.

5. The stilt of claim 1 where the core blocks each further comprising a single block of structural foam extending from said upper planer surface to said lower ground engaging surface.

6. The stilt of claim 1 where said ground engaging surface has yielding capability for yielding around and subducting stepped upon small objects.

7. The stilt of claim 1 where said boot attachment means comprising an ankle restraining strap, a toe restraining strap, and a heel positioning means for positioning said boot on said upper surface, where said straps and heel positioned are anchored by having portions embedded within the foam core block.

8. A stilt for raising a walker above a floor comprising:

a. a pair of approximately rectangular blocks of structural foam material serving as the core structure of the stilts, b. each core block being one piece and having an upper planer surface having a means to secure a boot to said upper surface, a post vertically extending from the upper planar surface, said post further including means for removably including a lower leg portion of a user to said post in order to provide stability during use of said stilt, and an opposite ground engaging surface approximately the same size and shape as said upper surface, and c. said upper surface having edges proximal to the boot heel, toe, inner side, and outer side, and said ground engaging surface having edges essentially parallel to the corresponding upper surface edges, and vertical surfaces extending between said upper edges and lower corresponding edges, whereby when the pair of stilts is worn by a walker, the walker's stance is normal, when standing his legs are in normal vertical alignment, and when walking said interior edges and surfaces of said core blocks do not collide, d. said ground engaging surface further having an extending ground engaging surface extending outwardly from the outer edge and forwardly from the heel edge toward the toe edge and coplanar with said ground engaging surface of said core block, thereby adding lateral stability to the stilt in the outward direction.

9. The stilt of claim 8 where the vertical corner edges of said core blocks are chamfered.

10. The stilt of claim 8 where the vertical corner edges of said core blocks are rounded.

11. The stilt of claim 8 where the core blocks each further comprising a single block of structural foam extending from said upper planer surface to said lower ground engaging surface.

12. The stilt of claim 8 where said ground engaging surface has yielding capability for yielding around and subducting stepped upon small objects.

13. The stilt of claim 8 where said boot attachment means comprising an ankle restraining strap, a toe restraining strap, and a heel positioning means for positioning said boot on said upper surface, where said straps and heel positioned are anchored by having portions embedded within the foam core block.

14. A stilt for raising a walker above a floor comprising:

a. a pair of approximately rectangular blocks of structural foam material serving as the core structure of the stilts, b. each core block being one piece and having an upper planer surface having a means to secure a boot to said upper surface, a post vertically extending from the upper planar surface, said post further including means for removably including a lower leg portion of a user to said post in order to provide stability during use of said stilt, and a first ground engaging surface opposite said upper surface and approximately the same size and shape as said upper surface, and c. said upper surface having edges proximal to the boot heel, toe, inner side, and outer side, and said ground engaging surface having edges essentially parallel to the corresponding upper surface edges, and vertical surfaces extending between said upper edges and lower corresponding edges, whereby when the pair of stilts is worn by a walker, the walker's stance is normal, when standing his legs are in normal vertical alignment, and when walking said interior edges and surfaces of said core blocks do not collide, d. said first ground engaging surfaces further having a second ground engaging surface extending outwardly from the outer edge and forwardly from the heel edge toward the toe edge and coplanar with said ground engaging surface of said core block, thereby adding lateral stability to the stilt in the outward direction, e. said first and second ground engaging surfaces further having the capability of yielding to stepped upon small objects and surrounding said objects, receiving them into said ground engaging surface, thereby causing the walker to be insensitive to said small objects having been stepped upon, and f. whereby when the pair of stilts is worn by a walker, the walker's stance is normal, when standing his legs are in normal vertical alignment, and when walking said interior edges and surfaces of said core blocks do not collide, overturning to the outside is inhibited, and the stilt absorbs unevenness in the floor caused by small objects lying thereon.

15. The stilt of claim 14 where the vertical corner edges of said core blocks are chamfered.

16. The stilt of claim 14 where the vertical corner edges of said core blocks are rounded.

17. The stilt of claim 14 where the core blocks each further comprising a single block of structural foam extending from said upper planer surface to said lower ground engaging surface.

18. The stilt of claim 14 where said ground engaging surfaces have yielding capability for yielding around and subducting stepped upon small objects.

19. The stilt of claim 14 where said boot attachment means comprising an ankle restraining strap, a toe restraining strap, and a heel positioning means for positioning said boot on said upper surface, where said straps and heel positioned are anchored by having portions embedded within the foam core block.

* * * * *